US005295523A

United States Patent [19]

Gentile

[11] Patent Number: 5,295,523

[45] Date of Patent: Mar. 22, 1994

[54] ADJUSTABLE STROKE MULTIPLE PACKAGE FILLING APPARATUS

[76] Inventor: Aliseo Gentile, 8011 Schneider, Manchester, Mich. 48158

[21] Appl. No.: 865,924

[22] Filed: Apr. 9, 1992

[51] Int. Cl.[5] ..... B67C 3/02; B65B 43/56

[52] U.S. Cl. ..... 141/244; 141/89; 141/90; 141/91; 141/115; 141/177; 141/266; 141/178; 141/84

[58] Field of Search ..... 141/234–238, 141/115, 116, 119, 126, 129, 263, 181, 242–245, 170, 177–179, 270, 386, 260, 261, 279, 388, 166, 165, 127, 117, 114, 99, 26, 25, 10, 2, 89–92, 266; 222/255, 265, 275; 251/5

[56] References Cited

U.S. PATENT DOCUMENTS

| | | | |
|---|---|---|---|
| Re. 29,482 | 11/1977 | Rosen | 141/179 |
| 467,086 | 1/1892 | Donally | 141/242 |
| 1,227,628 | 5/1917 | Kiefer | 141/244 |
| 3,511,468 | 5/1970 | Young | 141/116 |
| 3,554,674 | 1/1971 | Huret | 141/129 |
| 3,911,976 | 10/1975 | Rosen | 141/84 |
| 3,939,883 | 2/1976 | Harrell et al. | 222/255 |
| 4,000,765 | 1/1977 | Lydiksen | 141/181 |
| 4,004,620 | 1/1977 | Rosen | 141/179 |
| 4,077,441 | 3/1978 | Rosen et al. | 141/1 |
| 4,453,576 | 6/1984 | Burns | 141/129 |
| 4,651,788 | 3/1987 | Grosskreuz et al. | 141/242 |
| 4,840,205 | 6/1989 | Drevfors et al. | 141/114 |
| 5,002,100 | 3/1991 | Frederick | 141/242 X |

*Primary Examiner*—Ernest G. Cusick

*Attorney, Agent, or Firm*—James M. Deimen

[57] ABSTRACT

Package or container product filling apparatus that can easily be disassembled for cleaning and reassembled comprises a hopper and manifold to supply a plurality of package dosing filling tubes in turn insertable in multiple packages simultaneously. The manifold supplies a plurality of flexible tubes leading to a plurality of bellows type reciprocable dosing pumps. The dosing pumps in turn supply product through flexible tubes to the filling tubes. Any parts through which product passes or contacts are simply connected requiring no tools for disassembly or assembly. The bellows chambers and check valves of the dosing pumps are constructed of inexpensive plastic and discarded when the apparatus is disassembled for cleaning because they are relatively difficult to clean with absolute assurance that no product remains to contaminate a subsequent different product. The remaining mechanical portions of the dosing pumps do not contact the product. The metal portions of the apparatus comprising the hopper, manifold and filling tubes simply rest in brackets or holes and are simply lifted out or inserted in to disassemble or assemble respectively. The flexible tubes are smooth-walled plastic and therefore may be cleaned or discarded with disassembly as desired. The apparatus also includes externally actuated means to suck back product at the lower ends of the filling tubes to prevent dribble between filling cycles. The suck back means does not contact the product and therefore does not require disassembly for cleaning.

10 Claims, 2 Drawing Sheets

ADJUSTABLE STROKE MULTIPLE PACKAGE FILLING APPARATUS

BACKGROUND OF THE INVENTION

The field of the invention pertains to dosing apparatus for the automatic filling of preformed packages with liquid or highly viscous materials and, in particular, to apparatus that can be adjusted for weight or volume without spillage and can be quickly disassembled, cleaned and reassembled.

Examples of the preformed packages to which the apparatus is particularly suited are disclosed in U.S. Pat. No. 4,717,046 and German invention document DE 3143 671 A1 wherein a separable top or tongue may be torn off to provide the dispensing outlet for the package, however, the disclosure below is not limited to the particular packages disclosed in these publications. Rather, the filling apparatus may be used to fill a wide variety of preformed cartons, plastic bottles and glass bottles.

U.S. Pat. No. 3,382,644 illustrates bag or package filling apparatus as a part of a bag forming and filling machine. In this machine the bags or packages are raised on fixtures to insert nozzles of the filling apparatus into the packages and the packages are filled before the packages are again lowered. Belgian invention publication No. 547082 discloses a package forming and filling sequence wherein open top formed packages are filled from hoppers that travel with the packages. The hoppers have filling tubes depending therefrom which enter the packages during the filling operation.

SUMMARY OF THE INVENTION

The invention comprises a greatly simplified adjustable dosing apparatus for package filling machines. Reference is made to companion U.S. application Ser. No. 07/865,983 wherein such a machine is described to which this apparatus is particularly suited. Although applicable to almost any liquid product from the thin and watery to very thick viscous pastes, the adjustable dosing apparatus is particularly suited to products that must be packaged essentially contamination free such as food items, creams and lotions, and medicinal items. The dosing apparatus is suitable for use on machines in clean rooms in particular.

Of particular advantage, the product containing hopper and manifold merely rest on brackets from which they can be easily lifted and disassembled for cleaning. The flexible connecting tubes are smooth walled plastic and the filling tubes smooth walled metal tubes that merely rest in a vertically movable carrier. As with the hopper and manifold the tubes can be disassembled for cleaning and reassembled without tools. The bellows pumps with check valves likewise can be removed from the machine without tools, however, because the bellows and check valves can not so easily be thoroughly cleaned, they are made from inexpensive plastic and are discarded to prevent any contamination with product changes.

Since the dosing apparatus may be used for products sensitive to degradation with time when exposed to the environment, ease of disassembly, cleaning and reassembly is paramount to the reduction of down time. Moreover, the dosing apparatus is particularly suitable for packaging and filling machines used by contract packagers who frequently change from one product run to another. Under such circumstances prevention of contamination by a previous product is paramount.

DESCRIPTION OF THE PREFERRED EMBODIMENT

Figure 1:
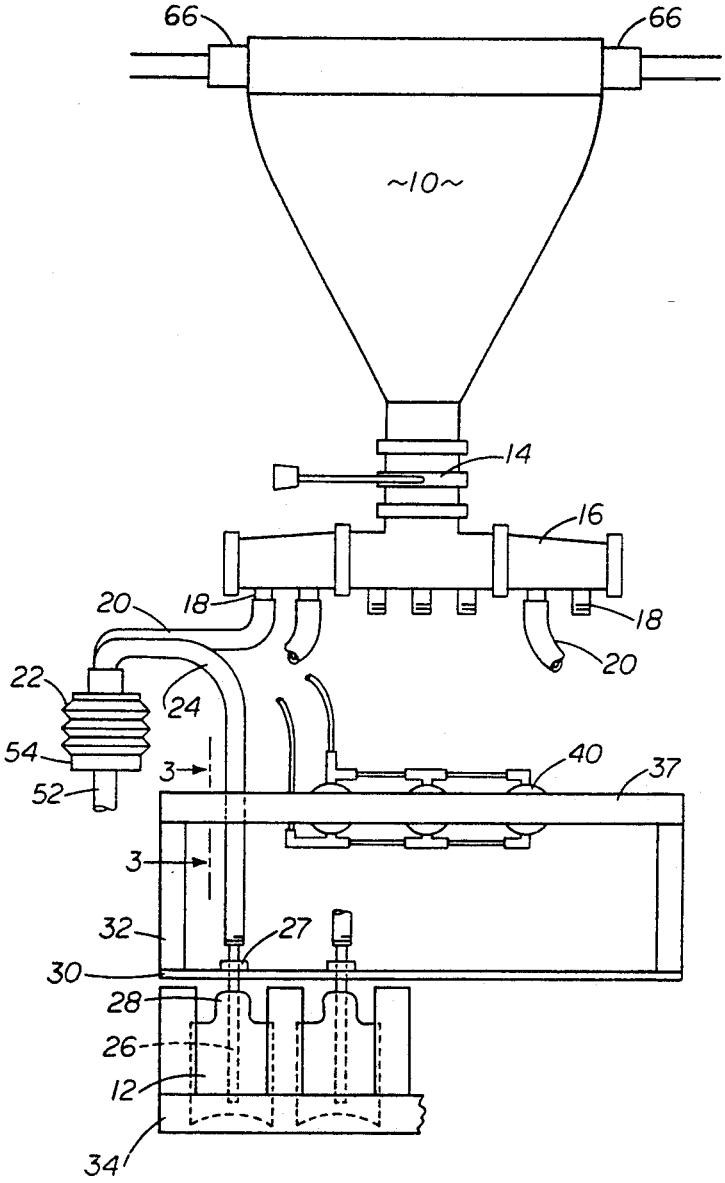
FIG. 1 is a schematic view of the filling apparatus with a filling tube inserted in a package.

Illustrated in FIG. 1 is a hopper 10 for the supply of filling product or material to be supplied to the individual packages 12 therebelow. The hopper 10 is connected with a circumferential quick disconnect clamp 14 to a manifold 16 having a plurality of orifice tubes 18. The orifice tubes 18 in turn are each connected through plastic tubes 20 to bellows pumps 22. The outlets of the bellows pumps 22 communicate through plastic tubes 24 with filling tubes 26. As shown the filling tubes 26 are fully lowered into the packages 12 through open tops 28 of the packages 12. Only one pumping and filling circuit is shown although for most applications and high production rates a plurality of circuits are used and packages are filled simultaneously.

A squeezing stroke of the bellows pumps 22 causes a measured dose of product to be expelled from the filling tubes 26 into the packages 12 as the filling tubes 26 are raised upwardly. Thus, product is bottom fed to the packages. To accomplish the filling stroke the filling tubes 26 are retained in a vertically movable frame member 30 and the lower portions of the tubes 24 grasped in the vertically movable frame 32. Thus, in FIG. 1 a filling tube 26 is shown in its lowermost position and in FIG. 2 in its uppermost position.

Figure 2:
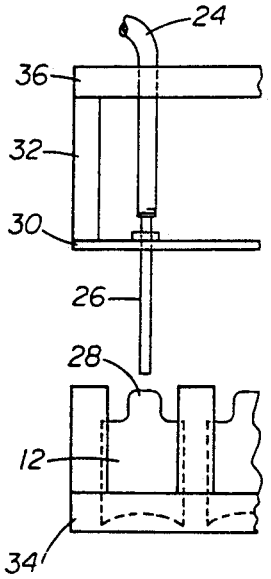
FIG. 2 is a schematic view of the filling nozzle retracted above the package.

As shown in FIGS. 1 and 2 the packages 12 are vertically positioned in horizontally movable fixtures 34. In their uppermost position the fillings tubes 26 clear the package tops 28 to permit the fixture 34 to remove the full packages and another fixture to carry empty packages into position beneath the filling tubes 26.

Figure 3:
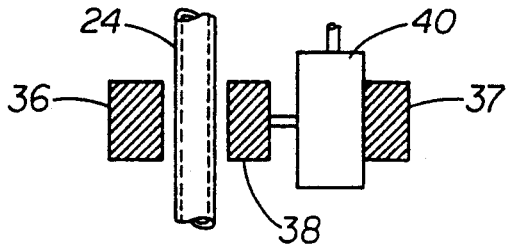
FIG. 3 is a schematic view of the suck back mechanism taken in the direction 3—3 in FIG. 1.

Intermediate the lowermost position and uppermost position on the upward filling stroke, the bellows pump 22 completes the product expulsion stroke. To control or eliminate drip or creep of excess product from the tips of the filling tubes 26, the plastic tubes 24 are grasped between frame members 36 and 38 as shown in FIG. 3. Frame member 38 is movable relative to frame member 36 to squeeze shut plastic tubes 24 upon completion of the product expulsion stroke by the bellows pumps 22. A plurality of air cylinders 40 are employed to provide even squeezing of all tubes 24 by member 38 thus terminating flow of product. The air cylinders 40 react against frame member 37 and the entire assembly raises and lowers with the filling tubes 26.

With the beginning of the expansion stroke of the bellows pumps 22, the outlet valve within the bellows pumps closes sealing the upper ends of the tubes 24. With the tubes 24 thus sealed the air cylinders 40 open the frame members 36 and 38 causing a slight momentary suction or "suck back" in the filling tubes 26 and thereby controlling or preventing drip or creep of product from the tips of the filling tubes 26. Suction is maintained merely by the viscosity and surface tension of the product until the filling tubes 26 are again lowered into empty packages to repeat the filling cycle.

Figure 4:
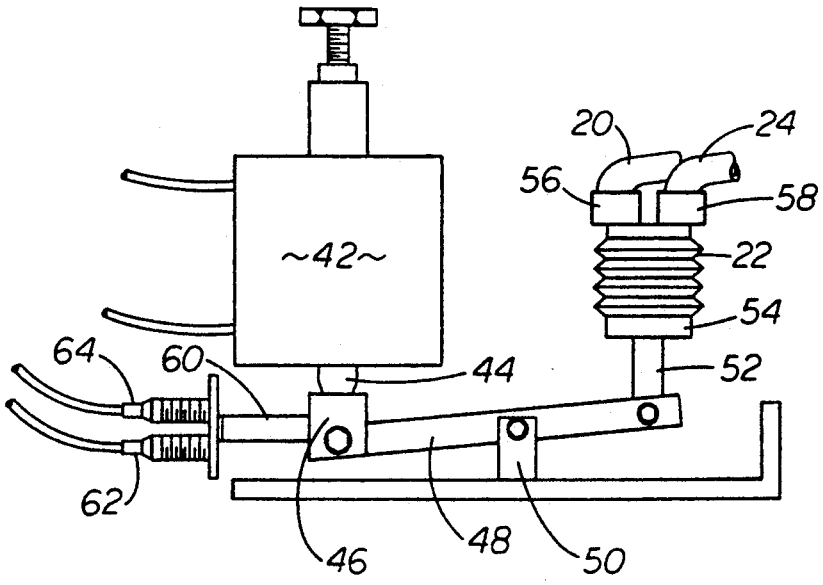
FIG. 4 is a schematic view of the adjustable pumping mechanism for the filling apparatus.

In FIG. 4 the mechanism for actuating a bellows pump 22 comprises an adjustable stroke air cylinder 42 wherein the piston rod 44 engages a lever arm tip 46 and arm 48. The arm 48 rotates about a fulcrum 50 with a pump rod 52 attached at the end opposite the air cylinder 42. Affixed to the upper end of the pump rod 52 is an internally threaded cap 54. The bellows pump 22 base is threaded into the cap 54. Inlet tube 20 and outlet tube 24 are connected to the bellows pump 22 through internal inlet poppet valve 56 and internal outlet poppet valve 58. Thus, the adjustable stroke of the air cylinder piston rod 44 adjusts the stroke of the bellows pump 22 and the quantity of product dispensed. An extension 60 affixed to the lever arm tip 46 reciprocates between a pair of proximity sensors 62 and 64 to sense the operation of the bellows pump 22. These sensors 62 and 64 indicate if no dose of product has been fed to a package. The mechanism illustrated in FIG. 4 is repeated for each of the bellows pumps of the apparatus.

In the preferred embodiment above described the apparatus is particularly suited to ease of disassembly, cleaning and reassembly of all parts contacted by product. The hopper 10, manifold 16 and clamp 14 are constructed of stainless steel. The tubes 20 and 24 are constructed of a flexible food grade plastic such as polyethylene and internally smooth. The filler tubes 26 are straight smooth walled stainless steel with no internal changes in cross-section. Collars 27 are affixed to the filler tubes 26 to retain the tubes in holes in frame member 30. The plastic tube 20 and 24 connections are sized for frictional engagement with the manifold orifice tubes 18 and the filling tubes 26 as well as with the bellows pump 22 inlet and outlet. The hopper 10 and manifold 16 rest in brackets 66.

Thus, for change of product cleaning the plastic tubes 20 and 24 are slipped off, the hopper 10 and manifold 16 lifted out of the brackets 66 (and machine in which the package filling apparatus is installed) and disconnected at clamp 14. The bellows pump 22 is unscrewed from the cap 54 and the filling tubes 26 are lifted from the holes in the frame member 30. The bellows pump 22 and valves 56 and 58, having product contacting areas difficult to clean, are constructed of inexpensive plastics and discarded. The plastic tubes 20 and 24 may be cleaned or discarded as desired and the remaining stainless steel hopper 10, manifold 16 and filling tubes 26 cleaned. No complicated drive, adjusting or sensing devices contact product, therefore they need not be disassembled, cleaned or discarded. Turn-around time for changes in product are greatly decreased in comparison with prior art machines wherein disassembly, cleaning and reassembly require many hours of machine down time.

I claim:

1. Apparatus to fill open top packages comprising a hopper and a manifold in communication with the hopper, a plurality of orifice tubes extending from the manifold, a first plurality of flexible tubes each slideably attached to one of the orifice tubes, a plurality of corresponding dosing pumps each having an inlet and an outlet, the inlets thereof each slideably attached to each of the corresponding first plurality of flexible tubes, a second plurality of flexible tubes each slideably attached to the corresponding outlets of the plurality of dosing pumps, and a corresponding plurality of vertical filling tubes each slideably attached to the second plurality of flexible tubes, brackets attachable to a stationary supporting frame and adapted to gravitationally support the hopper, a frame movable relative to the stationary supporting frame and adapted to support the filling tubes, said filling tubes adapted to gravitationally rest in the movable frame, and releasable means to disconnect the manifold from the hopper, whereby the hopper, manifold, orifice tubes, flexible tubes, filling tube and dosing pumps comprising the product contacting elements of the apparatus can be disassembled and removed from the frames for cleaning or replacement, and reassembled, absent tools.

2. The apparatus of claim 1 including means adapted to momentarily squeeze shut and reopen the second plurality of flexible tubes upon completion of the dosing of product into packages thereby causing any product hanging at each of the open lower ends of the filling tubes to be sucked back into the filling tubes.

3. The apparatus of claim 2 wherein the squeezing means are mounted on the movable frame.

4. The apparatus of claim 1 wherein the dosing pumps each comprise plastic bellows chambers with check valves at the inlet and outlet, the plastic bellows being actuated by an adjustable stroke air cylinder to adjustably determine a quantity of product dosed to fill a package.

5. The apparatus of claim 4 wherein the plastic bellows chamber is discarded and replaced upon disassembly for cleaning.

6. Apparatus to fill open top packages comprising a hopper, a dosing pump having an inlet and an outlet, the inlet thereof in fluid communication with the hopper, the fluid communication including a first flexible tube slideably connected to the inlet of the dosing pump, a second flexible tube slideably connected to the outlet of the dosing pump, and a filling tube slideably connected to the second flexible tube, brackets permanently attachable to a stationary supporting frame and adapted to gravitationally support the hopper, and a frame movable relative to the stationary supporting frame and adapted to support the filling tube, said filling tube adapted to gravitationally rest in the movable frame, whereby the hopper, dosing pump, flexible tubes and filling tube comprising the product contacting elements of the apparatus can be disassembled and removed from the frames for cleaning or replacement and reassembled absent tools.

7. The apparatus of claim 6 including means adapted to momentarily squeeze shut and reopen the second tube upon completion of the dosing of product into a package thereby causing any product hanging at the open lower end of the filling tube to be sucked back into the filling tube.

8. The apparatus of claim 7 wherein the squeezing means are mounted on the movable frame.

9. The apparatus of claim 6 wherein the dosing pump comprises a plastic bellows chamber with check valves at the inlet and outlet, the plastic bellows being actuated by an adjustable stroke air cylinder to adjustably determine a quantity of product dosed to fill a package.

10. The apparatus of claim 9 wherein the plastic bellows chamber is discarded and replaced upon disassembly for cleaning.

* * * * *